US006622641B2

(12) United States Patent
Smyers

(10) Patent No.: US 6,622,641 B2
(45) Date of Patent: Sep. 23, 2003

(54) PALLET

(75) Inventor: Justin M. Smyers, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/970,267

(22) Filed: Oct. 3, 2001

(65) Prior Publication Data

US 2003/0061974 A1 Apr. 3, 2003

(51) Int. Cl.[7] ..... B65D 19/32

(52) U.S. Cl. ..... 108/56.1; 108/57.25; 108/901

(58) Field of Search ..... 108/902, 901, 108/51.11, 56.1, 53.3, 57.25, 57.28

(56) References Cited

U.S. PATENT DOCUMENTS

| | | | |
|---|---|---|---|
| 2,544,657 | A | 3/1951 | Cushman |
| 2,699,912 | A | 1/1955 | Cushman |
| 3,126,843 | A | 3/1964 | DeLaney |
| 3,307,504 | A | 3/1967 | Cloyd et al. |
| 3,467,032 | A | 9/1969 | Rowlands et al. |
| 3,602,157 | A | 8/1971 | Cohen |
| 3,651,769 | A | 3/1972 | Foley |
| 3,654,874 | A | 4/1972 | Skinner |
| 3,678,868 | A | 7/1972 | Hirota |
| 3,685,461 | A | 8/1972 | Belcher |
| 3,710,733 | A | 1/1973 | Story |
| D231,096 | S | 4/1974 | Adam |
| D232,019 | S | 7/1974 | Rehrig et al. |
| 3,824,933 | A | 7/1974 | Lind |
| 3,835,792 | A | 9/1974 | Wharton |
| 3,878,796 | A | 4/1975 | Morrison |
| 3,964,400 | A | 6/1976 | Brand |
| 4,051,787 | A | 10/1977 | Nishitani et al. |
| D246,296 | S | 11/1977 | Fujii et al. |
| 4,103,857 | A | 8/1978 | Levenhagen |
| 4,183,491 | A | 1/1980 | Sanders et al. |
| 4,287,836 | A | 9/1981 | Aoki |
| 4,316,419 | A | 2/1982 | Cupido |
| 4,403,555 | A | 9/1983 | Forrest |
| 4,597,338 | A | 7/1986 | Kreeger |
| 5,197,395 | A | 3/1993 | Pigott et al. |
| D346,681 | S | 5/1994 | Pigott et al. |
| D347,511 | S | 5/1994 | Pigott et al. |
| D371,882 | S | 7/1996 | Kristoffersson |
| 5,676,064 | A | 10/1997 | Shuert |
| 5,791,261 | A | 8/1998 | John et al. |
| 5,809,905 | A | 9/1998 | John et al. |
| 5,845,588 | A | 12/1998 | Gronnevik |
| 5,860,369 | A | 1/1999 | John et al. |
| 5,887,529 | A | 3/1999 | John et al. |
| 6,006,677 | A | 12/1999 | Apps et al. |
| 6,029,583 | A | 2/2000 | LeTrudet |
| 6,109,190 | A | 8/2000 | Hale et al. |

FOREIGN PATENT DOCUMENTS

| | | |
|---|---|---|
| DE | 2232200 | 1/1973 |
| DE | 27 33 457 | 2/1979 |

*Primary Examiner*—Janet M. Wilkens
(74) *Attorney, Agent, or Firm*—Brooks & Kushman P.C.

(57) ABSTRACT

A pallet is provided which includes spaced upper and lower decks. A plurality of receiving areas are formed in one of the upper and lower decks, where each receiving area includes at least one latch member extending therefrom. A plurality of corresponding supports extend from the other of the upper and lower decks, where each support includes at least one latch receiver extending therefrom, each latch receiver having a plurality of spring arms. The latch receiver is adapted to receive the latch member such that engagement of the receiving areas and corresponding supports securely joins the upper and lower decks in an assembled configuration.

34 Claims, 10 Drawing Sheets

PALLET

BACKGROUND OF THE INVENTION

1. Field of the Invention

This invention relates to pallets for supporting freight, goods, or other materials.

2. Background Art

Current plastic pallets have upper and lower decks that are optimally designed to serve their diverse purposes. Equally important to the specific structure of the upper and lower decks is the latching mechanism which secures the decks together in an assembled configuration. During handling, lateral movement of the upper and lower decks with respect to one another can cause the two decks to become disengaged. Therefore, a need exists for a pallet which provides a more secure latching feature as well as sufficient lateral constraint for the latching feature to enhance the attachment of the upper and lower decks so that they cannot be separated during use.

SUMMARY OF THE INVENTION

Therefore, it is an object according to the present invention to provide a pallet which includes more secure latching of the upper and lower decks in the assembled configuration.

It is another object according to the present invention to provide a pallet having improved lateral stability of the top and bottom decks with respect to each other.

It is another object according to the present invention to provide a pallet having guide features which improve alignment of the upper and lower decks for assembly.

It is still another object according to the present invention to provide a plastic pallet which is lightweight, strong, and durable.

Accordingly, a pallet is provided which includes spaced upper and lower decks. A plurality of receiving areas are formed in one of the upper and lower decks, where each receiving area includes at least one latch member extending therefrom. A plurality of corresponding supports extend from the other of the upper and lower decks, where each support includes at least one latch receiver extending therefrom, the latch receiver having a plurality of spring arms. The latch receiver is adapted to receive the latch member such that engagement of the receiving areas and corresponding supports securely joins the upper and lower decks in an assembled configuration.

In accordance with a preferred embodiment of the present invention, the receiving areas are integrally formed within a bottom surface of the upper deck, and the supports are integrally formed with and project upwardly from a top surface of the lower deck. Each receiving area includes a plurality of ribs, and each latch member extends outwardly from one of the ribs at a lower end thereof. In addition, each latch member preferably tapers upwardly and outwardly from the lower end of the rib and terminates in a generally horizontal shoulder portion.

Correspondingly, each support includes a plurality of ribs, and the plurality of spring arms includes two arms attached to one of the ribs at an upper end thereof. The arms are connected by a receiving face or bridge portion such that the latch receiver has a generally U-shaped appearance, where the bridge portion is adapted to receive the shoulder portion of the latch member thereunder. The latch receivers are preferably flexible, such that engagement of the receiving areas and corresponding supports causes the latch member to contact the receiving face and deflect the latch receiver outwardly from its resting position, and passage of the shoulder portion past the bridge portion allows the latch receiver to return to its rest position and securely retain the latch member therewithin.

In further accordance with a preferred embodiment of the present invention, guide members at least partially surrounding each latch receiver. Each guide member includes a wall structure having a first portion extending generally parallel to at least one latch receiver and a second portion extending along at least one side of one latch receiver. Guide members located at the corners of the pallet each include a curved wall which at least partially surrounds two adjacent latch receivers. The guide members are preferably tapered with the lower end of each guide member being wider than the upper end thereof. Correspondingly, each receiving area includes compartments which are sized to receive the individual guide members, where each compartment preferably includes one latch member. Engagement of the guide members with the receiving area compartments provides lateral stability for the assembled upper and lower decks.

The pallet according to the present invention is generally rectangular and includes twelve supports and twelve corresponding receiving areas. The lower deck includes a generally rectangular perimeter portion, an integrally formed longitudinal rail joined to the perimeter portion and extending along a longitudinal axis of the pallet, and two integrally formed transverse rails joined to the perimeter portion and the longitudinal rail and extending parallel to a transverse axis of the pallet. Together, the perimeter portion, the longitudinal rail, and the transverse rails define six large openings in the lower deck. Corner supports project from the four corners of the perimeter portion, medial supports project from each end of the longitudinal rail, and transverse supports project from the ends and midpoint of each transverse rail. In a preferred embodiment, the corner supports and medial supports each include eight spaced latch receivers, and the transverse supports each include six spaced latch receivers.

In addition, a pallet according to the present invention is provided having an upper deck including a plurality of receiving areas formed therein, each receiving area including at least one latch member extending therefrom. The pallet further includes a lower deck including a plurality of supports extending upwardly therefrom, each support including at least one latch receiver extending therefrom, where the latch receiver includes a plurality of spring supports. The latch receiver is adapted to receive the latch member such that engagement of the receiving areas and corresponding supports securely joins the upper and lower decks in an assembled configuration.

Still further, a latch assembly is provided according to the present invention for securely joining the upper and lower decks in an assembled configuration. The latch assembly includes at least one latch member disposed within each receiving area, the latch members each including a generally horizontal shoulder portion which tapers downwardly and inwardly toward a bottom surface of the receiving area. The latch assembly further includes at least one flexible latch receiver extending upwardly from each support, the latch receivers each having a plurality of spring arms connected to the support and a receiving face attached to the arms, wherein the receiving face is adapted to receive the shoulder portion of the latch member thereunder. In operation, engagement of the receiving areas and corresponding supports causes the latch member to contact the receiving face and deflect the latch receiver outwardly from its resting position, and passage of the shoulder portion past the receiving face allows the latch receiver to return to its rest position and securely retain the latch member therewithin, thereby securing the upper and lower decks in the assembled configuration.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
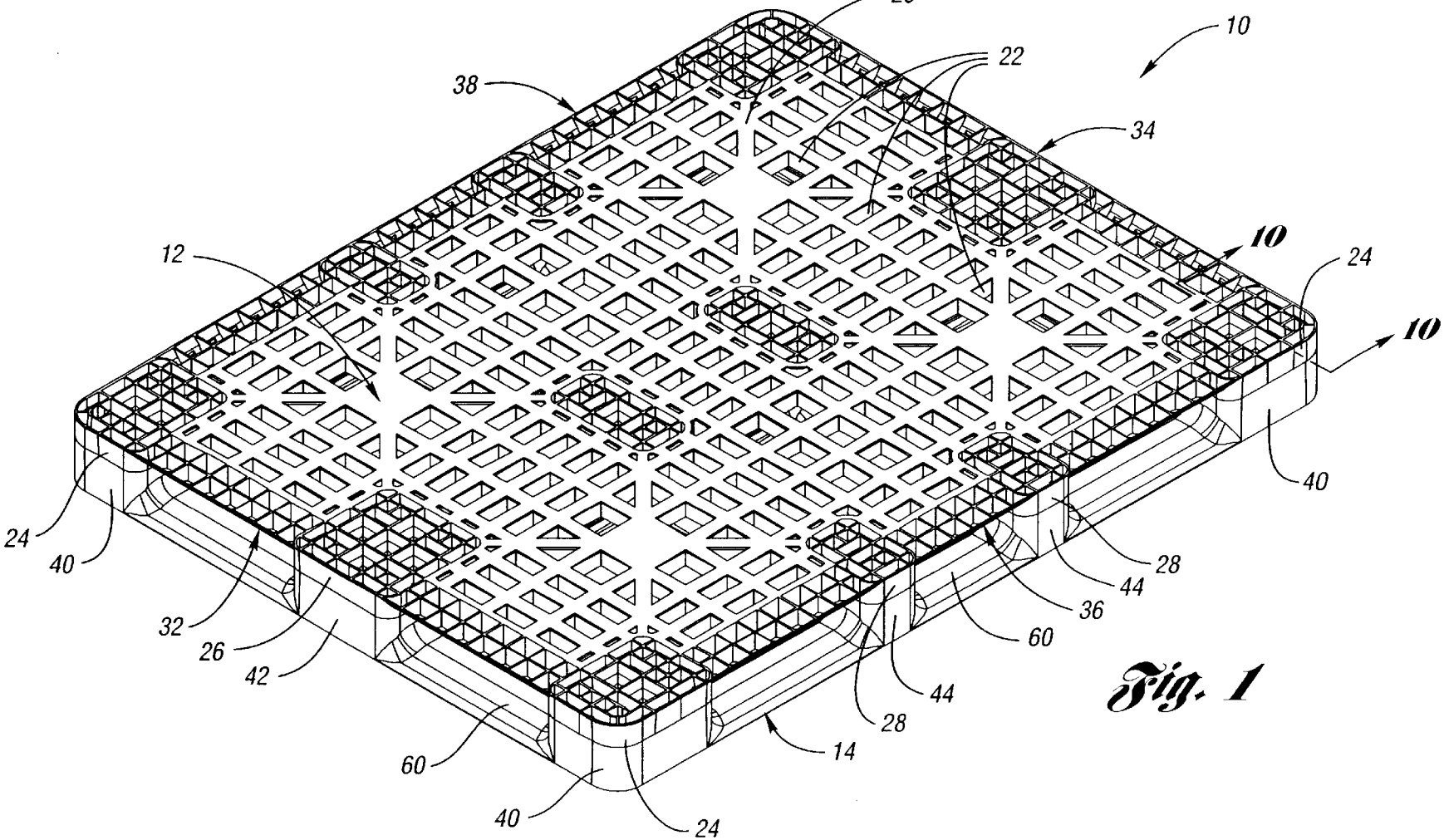
FIG. 1 is a top perspective view of an assembled pallet according to the present invention.

Referring first to FIGS. 1–6, a pallet according to the present invention is illustrated and designated generally by reference numeral 10. Pallet 10 includes two separately molded parts, namely an upper deck 12 and a lower deck 14. Upper deck 12 and lower deck 14 are injection molded of a suitable plastic material, such as high density polyethylene, polypropylene, or filled polypropylene. In plan view (FIGS. 3 and 4), pallet 10 is generally rectangular in shape with rounded corners and has symmetry about a longitudinal axis 16 and a transverse axis 18 thereof. The symmetrical two-piece injection molded plastic construction of pallet 10 affords substantial strength and durability, simplicity, and easy assembly. As explained below, upper and lower decks 12, 14 are adapted to be easily snapped together to form the assembled pallet illustrated in FIGS. 1–6.

Figure 7:
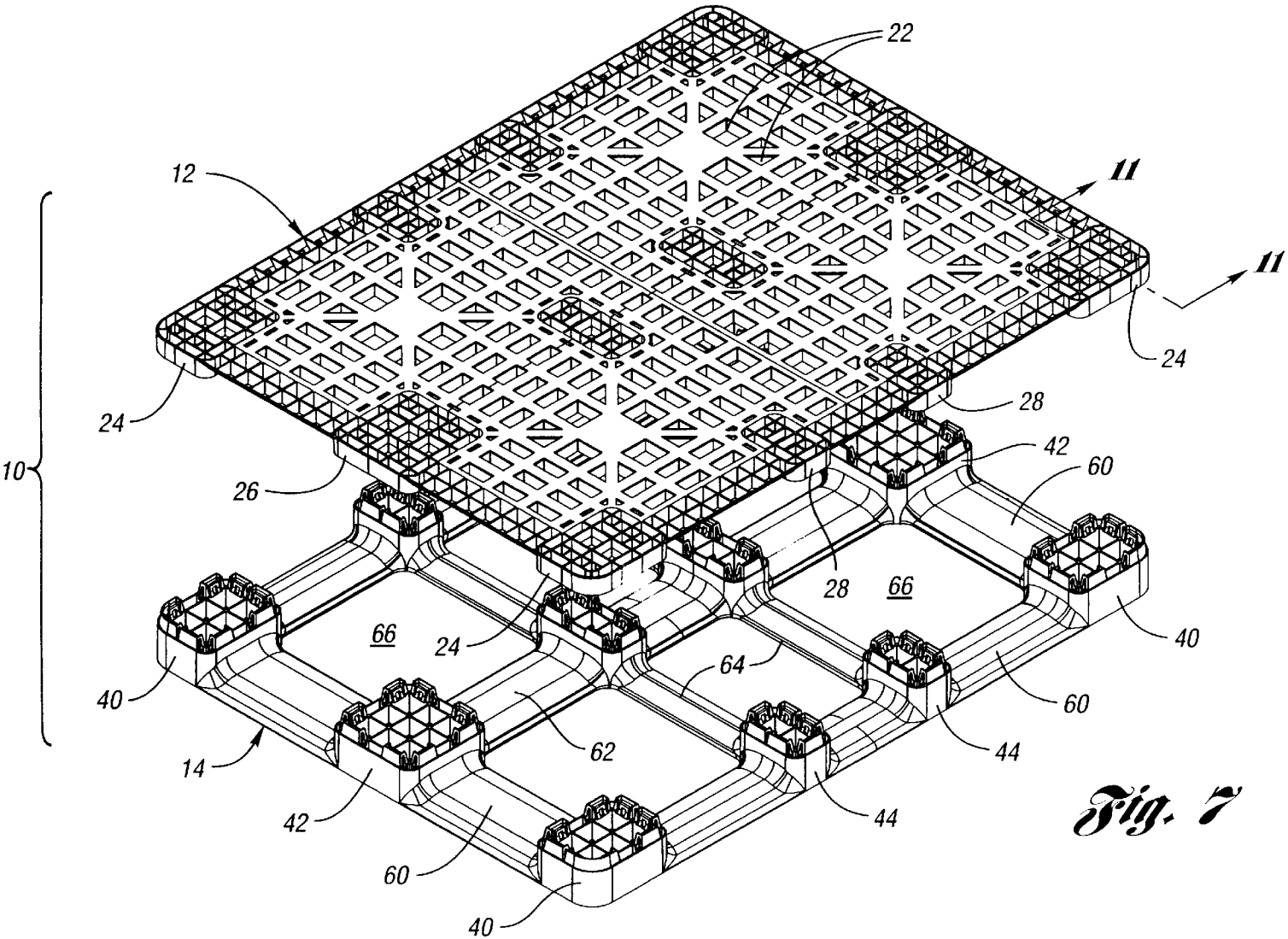
FIG. 7 is a top perspective, exploded view of the pallet of FIG. 1, showing the upper and lower decks aligned for assembly.
Figure 8:
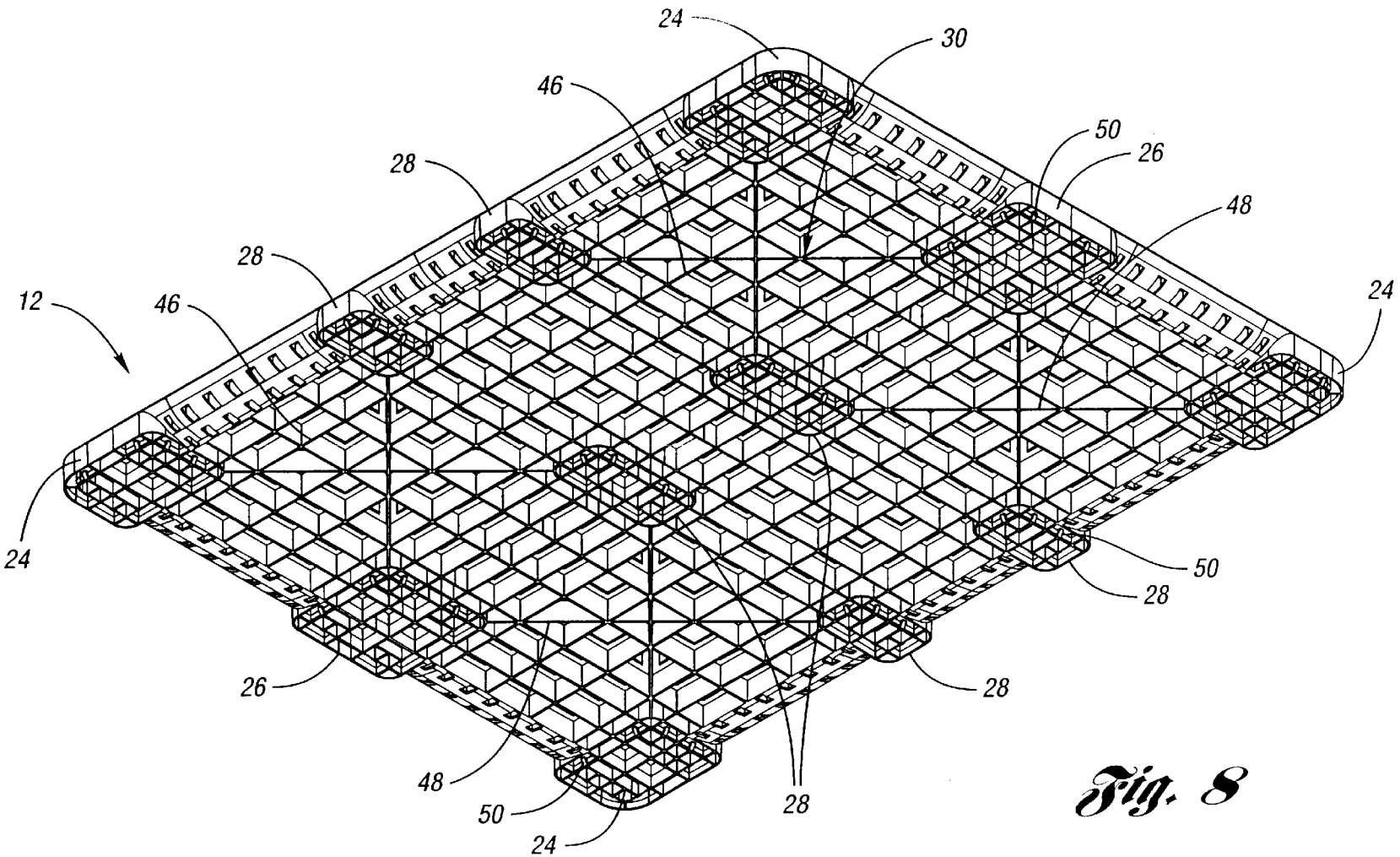
FIG. 8 is a bottom perspective view of the upper deck of the pallet of FIG. 7.

Referring now to FIGS. 1, 3, and 7–8, upper deck 12 has a solid top surface 20 interrupted by a series of apertures 22 which reduce the weight of upper deck 12 and allow for drainage in the event that pallet 10 becomes wet. As shown in FIG. 8, a plurality of receiving areas 24, 26, 28 are integrally formed within the bottom surface 30 of upper deck 12. More specifically, at each of the four corners of the upper deck 12, a generally rectangular corner receiving area 24 is formed. At the mid-point of the left side 32 and right side 34 of the pallet 10, generally square medial receiving areas 26 are formed. In addition, on either side of transverse axis 18, generally rectangular transverse receiving areas 28 are formed. Transverse receiving areas 28 are located along front side 36 of pallet 10, rear side 38 of pallet 10, and centrally intersecting with longitudinal axis 16. As shown in FIG. 8, receiving areas 24, 26, 28 all preferably have rounded corners. Of course, other shapes and configurations of receiving areas 24, 26, 28 are fully contemplated in accordance with the present invention. These twelve receiving areas 24, 26, 28 are adapted to receive twelve corresponding supports 40, 42, 44 which are integrally molded with lower deck 14, as described below with reference to FIGS. 7 and 9–11.

As shown in FIG. 8, ribs 46 on the bottom surface 30 of upper deck 12 form an orthogonal pattern which runs parallel and perpendicular to the sides 32, 34, 36, 38 while still other ribs 48 form another orthogonal pattern that is set at 45° to the first pattern. Ribs 46, 48 collectively form interconnected grid-like structures which span the spaces between receiving areas 24, 26, 28. As can be seen in FIG. 8, the bottom surface 30 of upper deck 12 is substantially planar in that receiving areas 24, 26, 28 and ribs 46, 48 generally lie in a common plane.

Figure 8A:
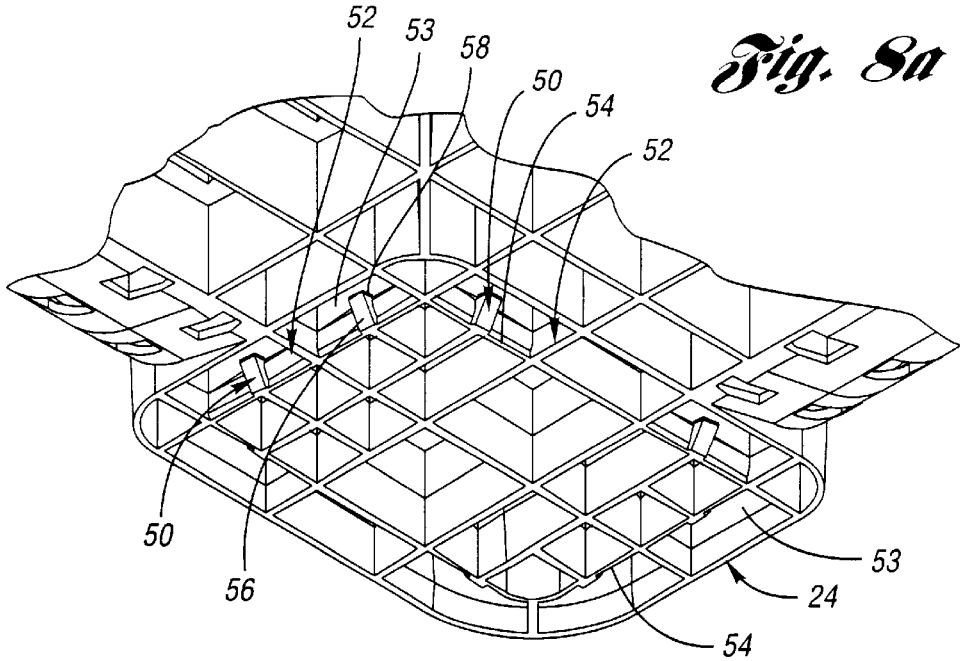
FIG. 8*a* is an enlarged perspective view of a corner portion of the upper deck of FIG. 8.
Figure 10:
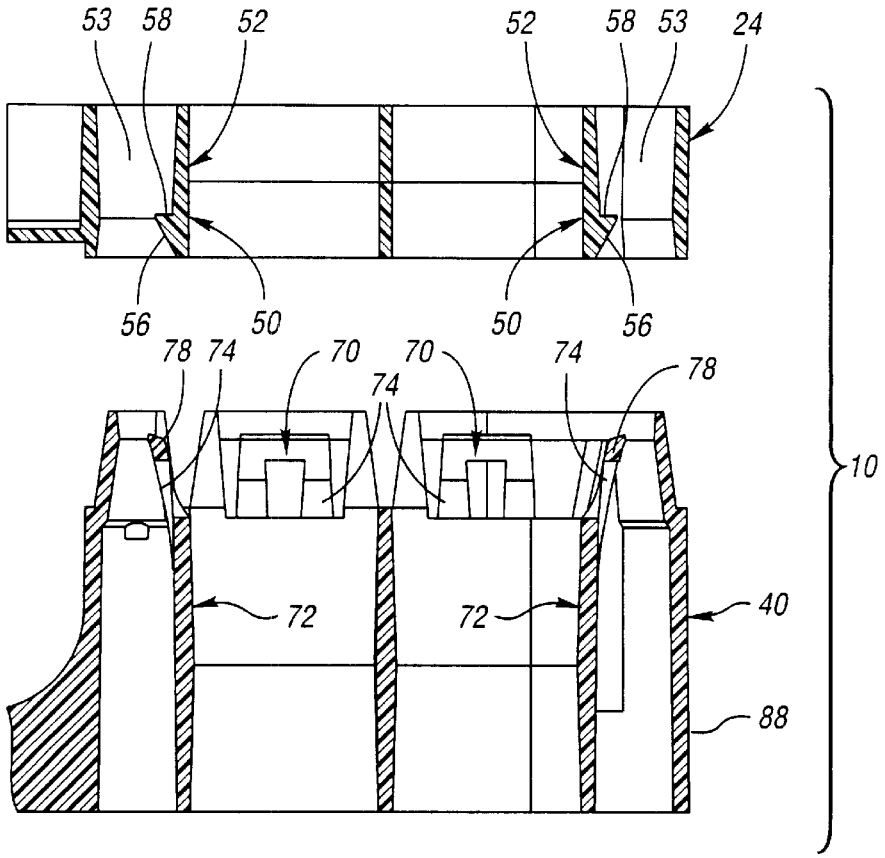
FIG. 10 is a cross-sectional view taken along line 10—10 of FIG. 1 showing the upper and lower decks prior to assembly.
Figure 11:
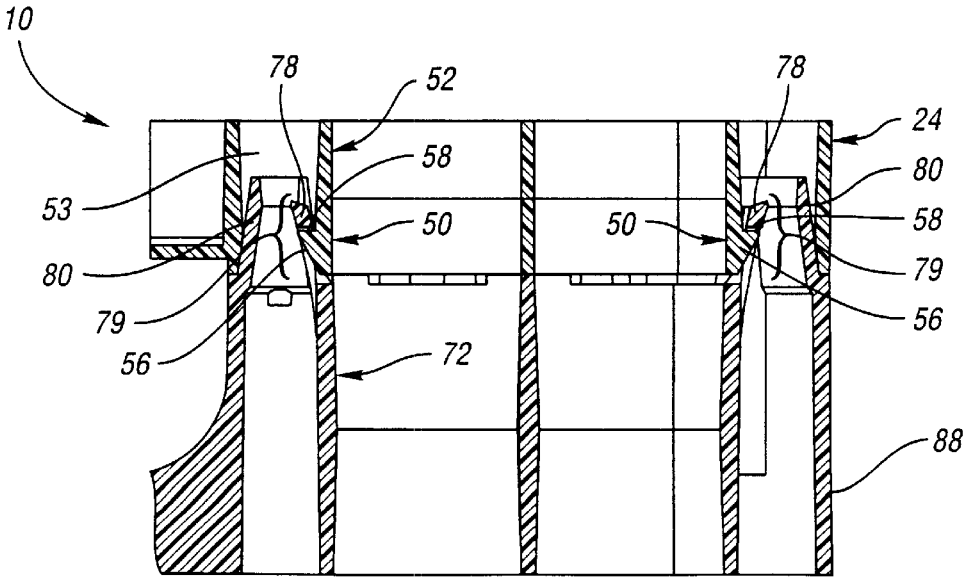
FIG. 11 is a cross-sectional view taken along line 11—11 of FIG. 7 showing the upper and lower decks in an assembled configuration.

In each of the receiving areas 24, 26, 28, there are a number of depending latch members or tabs 50, details of which are best shown in the enlarged view of FIG. 8*a* and the cross-sectional views of FIGS. 10 and 11. Each receiving area 24, 26, 28 includes a plurality of ribs 52, and each latch tab 50 is integrally and rigidly formed with one of the ribs 52 and extends outwardly therefrom at a lower end 54 thereof. Each latch tab 50 preferably has a tapered portion 56 which tapers upwardly and outwardly from the rib lower end 54 and terminates in a generally horizontal shoulder portion 58 which is received by components of the mating support 40, 42, 44 of lower deck 14 as described below. By way of example, in the embodiment shown each corner receiving area 24 and medial receiving area 26 includes eight latch tabs 50, with two latch tabs 50 disposed on each side thereof. Each transverse receiving area 28 includes six latch tabs 50, with two tabs 50 disposed on each of the sides disposed parallel to transverse axis 18 and one tab 50 disposed on each of the sides disposed parallel to longitudinal axis 16. Of course, other numbers and placements of latch tabs 50 within receiving areas 24, 26, 28 may be utilized in practicing the present invention.

Figure 9A:
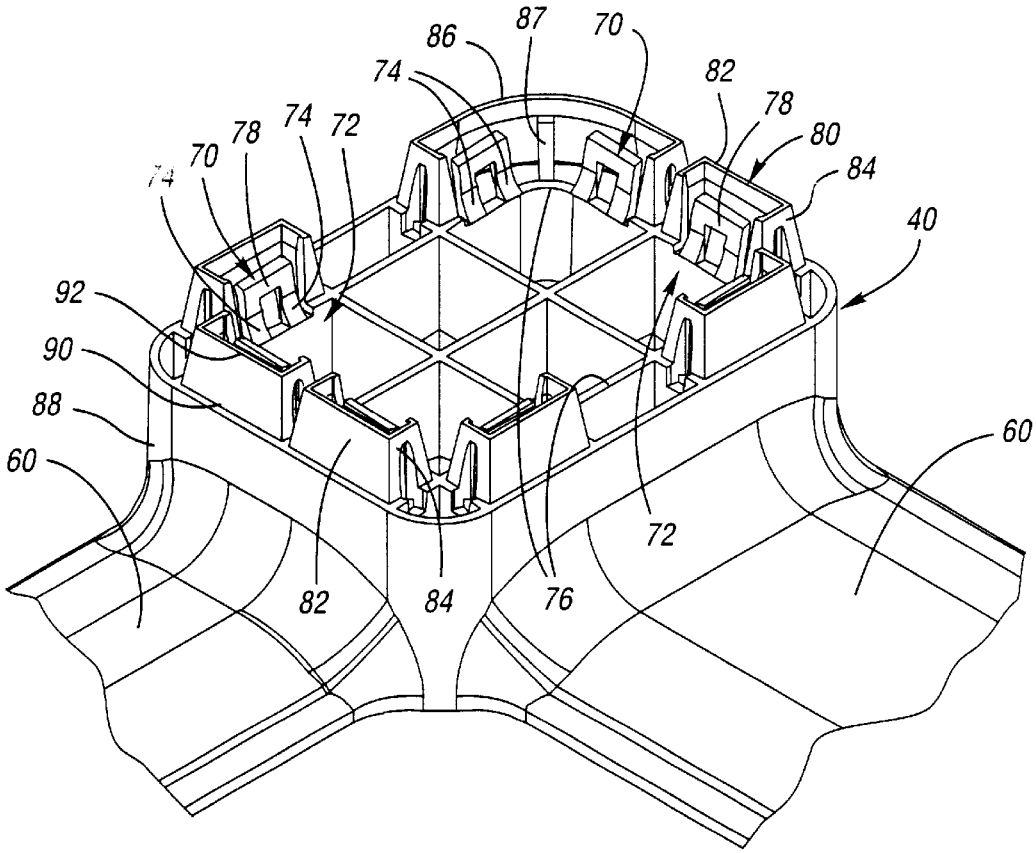
FIG. 9*a* is an enlarged perspective view of a corner portion of the lower deck of FIG. 9, wherein the lower deck corner portion is adapted to engage the corresponding upper deck corner portion shown in FIG. 8*a;*
Figure 9:
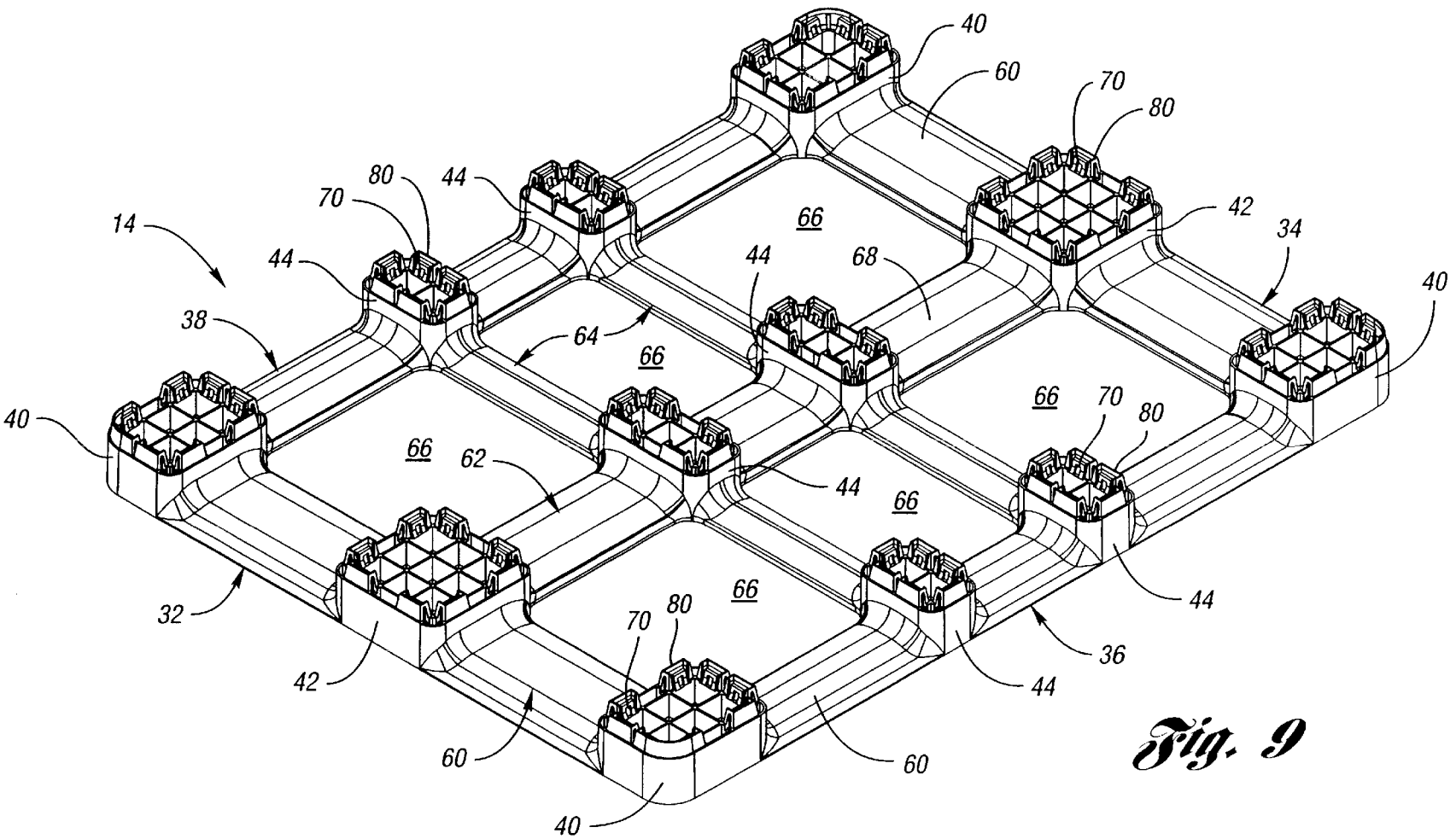
FIG. 9 is a top perspective view of the lower deck of the pallet of FIG. 7.

Referring next to FIGS. 7 and 9, lower deck 14 has a footprint which substantially matches that of upper deck 12, but differs substantially in structure. Lower deck 14 includes a generally rectangular perimeter portion 60, an integrally formed longitudinal member or rail 62 joined to the perimeter portion 60 along the left side 32 and right side 34 of pallet 10 and extending along longitudinal axis 16. In addition, two integrally formed transverse members or rails 64 are joined to the perimeter portion 60 along the front side 36 and rear side 38 of pallet 10. Transverse rails 64 are also joined with the longitudinal rail 62 and extend parallel to transverse axis 18 on either side thereof. Together, perimeter portion 60, longitudinal rail 62, and transverse rails 64 define six relatively large openings 66 in lower deck 14.

Perimeter portion 60 and rails 62, 64 preferably have beveled edges, and may optionally include apertures formed therein (not shown). The substantial amount of open area strategically placed within lower deck 14 minimizes the amount of material required without compromising structural rigidity.

As shown in FIGS. 7 and 9, twelve supports 40, 42, 44 corresponding respectively to receiving areas 24, 26, 28 are integrally formed with and project upwardly from a top surface 68 of lower deck 14. Corner supports 40 project from the four corners of perimeter portion 60, medial supports 42 project from each end of longitudinal rail 62, and transverse supports 64 project from the ends and midpoint of each transverse rail 64. In the embodiment depicted herein, corner supports 40 and transverse supports 44 are generally rectangular in cross-section, while medial supports 42 are generally square in cross-section. Supports 40, 42, 44 preferably have smooth, rounded outside surfaces to prevent damage from the forks of a fork lift and, as with recesses 24, 26, 28, can have shapes other than those illustrated herein. With reference to the assembled pallet views of FIGS. 1–2 and 5–6, the areas between supports 40, 42, 44 are fork-receiving regions which are intended to rest on the forks of a fork lift that can engage pallet 10 from any side 32, 34, 36, 38 thereof.

As best shown in the enlarged view of FIG. 9*a* and the cross-sectional views of FIGS. 10 and 11, each support 40, 42, 44 includes at least one latch receiver 70 extending therefrom. Latch receiver 70 is spring-loaded, having a plurality of spring supports or arms 74 which attach the latch receiver 70 to the support 40, 42, 44. In the embodiment shown herein, each support 40, 42, 44 includes a plurality of ribs 72, and each latch receiver 70 includes two spaced arms 74 attached to one of the ribs 72 at an upper end 76 thereof. Arms 74 are connected by a receiving face or bridge portion 78 disposed therebetween, such that latch receiver 70 has a generally U-shaped appearance. Of course, latch receiver 70 can include any number of spring arms 74 in accordance with the present invention.

As described below, latch receivers 70 are flexible, leaf springs that are adapted to receive latch tabs 50 of upper deck 12 to form a latch assembly 79 (see FIG. 11), such that engagement of the receiving areas 24, 26, 28 and corresponding supports 40, 42, 44 securely joins the upper and lower decks 12, 14 in an assembled configuration. Advantageously, having two spring supports 74 provides a twice greater holding force compared with a single arm 74 without increasing the stress upon the material. In the embodiment shown herein, corner supports 40 and medial supports 42 each include eight spaced latch receivers 70 and transverse supports 44 each include six spaced latch receivers 70, wherein the placement of latch receivers correspond in position to the placement of latch tabs 50 formed on opposed receiving areas 24, 26, 28.

In further accordance with the present invention, guide members 80 are provided which at least partially surround each latch receiver 70 (FIGS. 9 and 9*a*). Each guide member 80 includes a wall structure having a first portion 82 extending generally parallel to latch receiver 70 and second portions 84 extending along the sides of latch receiver 70. Guide members 80 located at the corners of pallet 10 additionally include a curved wall 86 which at least partially surrounds two adjacent latch receivers 70 and includes a support rib 87 extending inwardly therefrom at the corner of pallet 10. Referring again to FIG. 8*a,* ribs 52 within each receiving area 24, 26, 28 form compartments 53 which are sized to receive the individual guide members 80, where each compartment 53 preferably houses one latch member 50. Guide members 80 are inset from lower portion 88 of each support 40, 42, 44 for easier insertion into compartments 53 of corresponding receiving areas 24, 26, 28. In addition, guide members 80 are preferably tapered with the lower end 90 of each guide member 80 being wider than the upper end 92 thereof.

Advantageously, guide members 80 provide locating capability and alignment for engagement of supports 40, 42, 44 with corresponding receiving areas 24, 26, 28 during assembly of the upper and lower decks 12, 14 of pallet 10. Once the upper and lower decks 12, 14 are fully seated in an assembled position, the engagement of guide members 80 with receiving area compartments 53 provides lateral constraint preventing upper and lower decks 12, 14 from transverse movement with respect to one another which could cause the disengagement of the latch tabs 50 and latch receivers 70. The configuration of pallet 10 according to the present invention wherein many guide members 80 are provided to at least partially surround each individual latch receiver 70 greatly improves the lateral stability of the assembled pallet 10. Furthermore, guide members 80 protect the latch assembly 79 (FIG. 11) and limit the relative freedom of movement and reduce the forces that each latch assembly 79 will encounter.

FIGS. 7, 8*a,* and 10 depict how the two pallet decks 12, 14 are aligned for assembly. In FIGS. 8*a* and 10, corner support 40 and receiving area 24 are shown for exemplary purposes to illustrate the engagement of the upper and lower decks 12, 14, wherein their engagement is representative of the engagement between other receiving areas 24, 26, 28 and corresponding supports 40, 42, 44.

Figure 4:
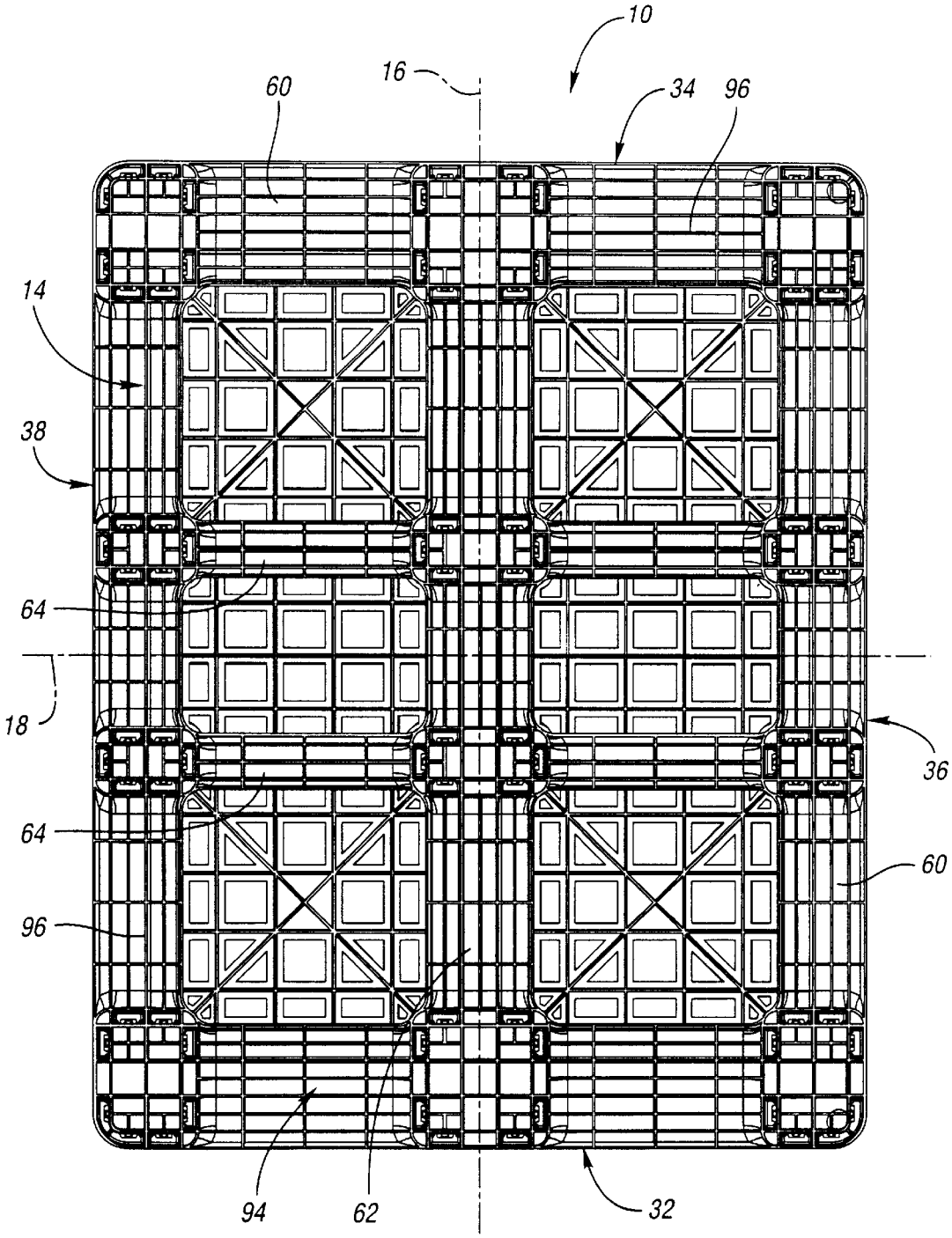
FIG. 4 is a bottom plan view of the pallet of FIG. 1.
Figure 4A:
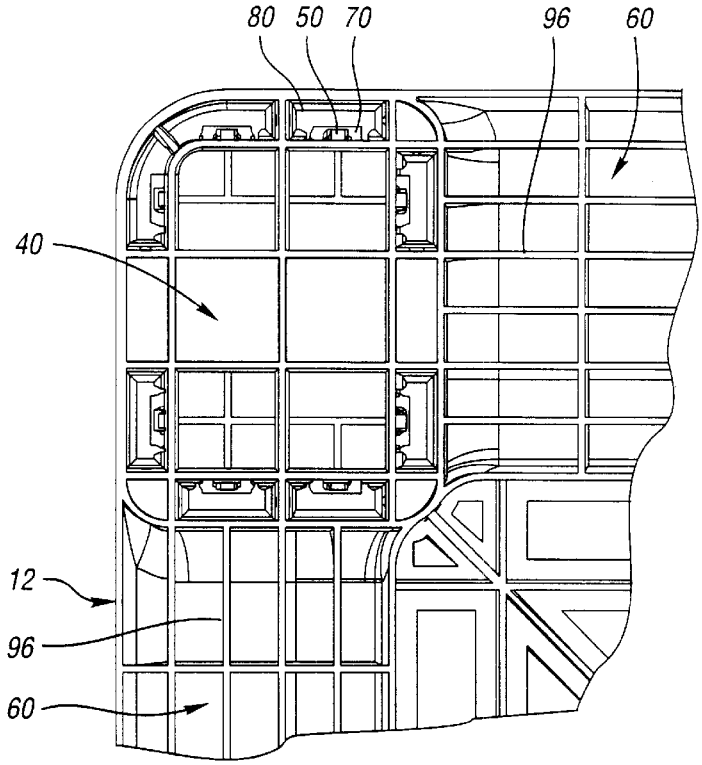
FIG. 4*a* is an enlarged bottom plan view of a corner portion of the pallet shown in FIG. 4.
Figure 5:
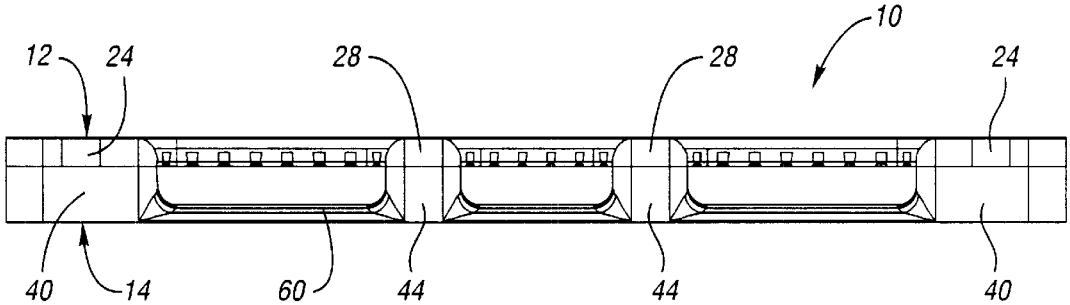
FIG. 5 is a front elevational view of the pallet of FIG. 1, the rear elevational view being a mirror image thereof.
Figure 6:
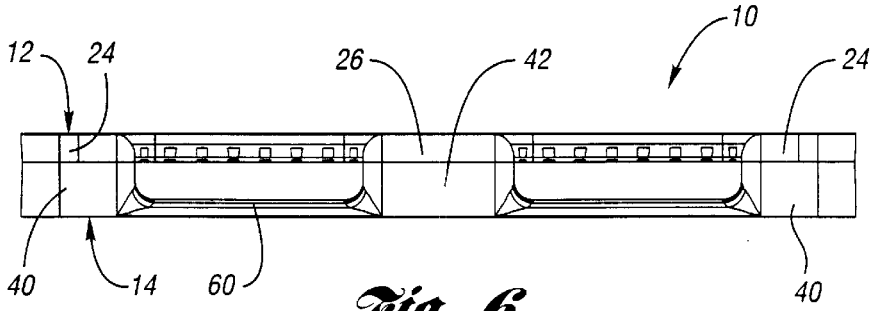
FIG. 6 is a left side elevational view of the pallet of FIG. 1, the right side elevational view being a mirror image thereof.

With reference now to FIGS. 4*a,* 8*a,* 9*a,* and the cross-sectional views of FIGS. 10–11, bridge portion 78 of latch receiver 70 is adapted to receive shoulder portion 58 of latch tab 50 thereunder. Engagement of receiving area 24 and corresponding support 40 causes tapered portion 56 of latch tab 50 to contact bridge portion 78 and deflect latch receiver 70 outwardly (to the left in FIG. 10) from its resting position. As decks 12, 14 are further advanced toward each other, passage of shoulder portion 58 past bridge portion 78 allows latch receiver 70 to spring inwardly to return to its rest position and securely capture latch tab 50 therewithin (FIGS. 4*a* and 11).

In operation, therefore, latch receiver 70 acts like a leaf spring. Due to the configuration of latch receiver 70 wherein two arms 74 are attached to each support rib 72, the force required to deflect latch receiver 70 is distributed over a large area, thereby decreasing the stress imparted to the plastic material.

Engagement of each of the twelve receiving areas 24, 26, 28 and corresponding supports 40, 42, 44 is accomplished simultaneously in the manner described above. Since each engaged receiving area 24, 26, 28 and support 40, 42, 44 includes multiple latch assemblies 79, a very secure connection between upper and lower decks 12, 14 is provided. Additionally, upper deck 12 completely covers the supports 40, 42, 44, thereby preventing debris from collecting therein.

Figure 2:
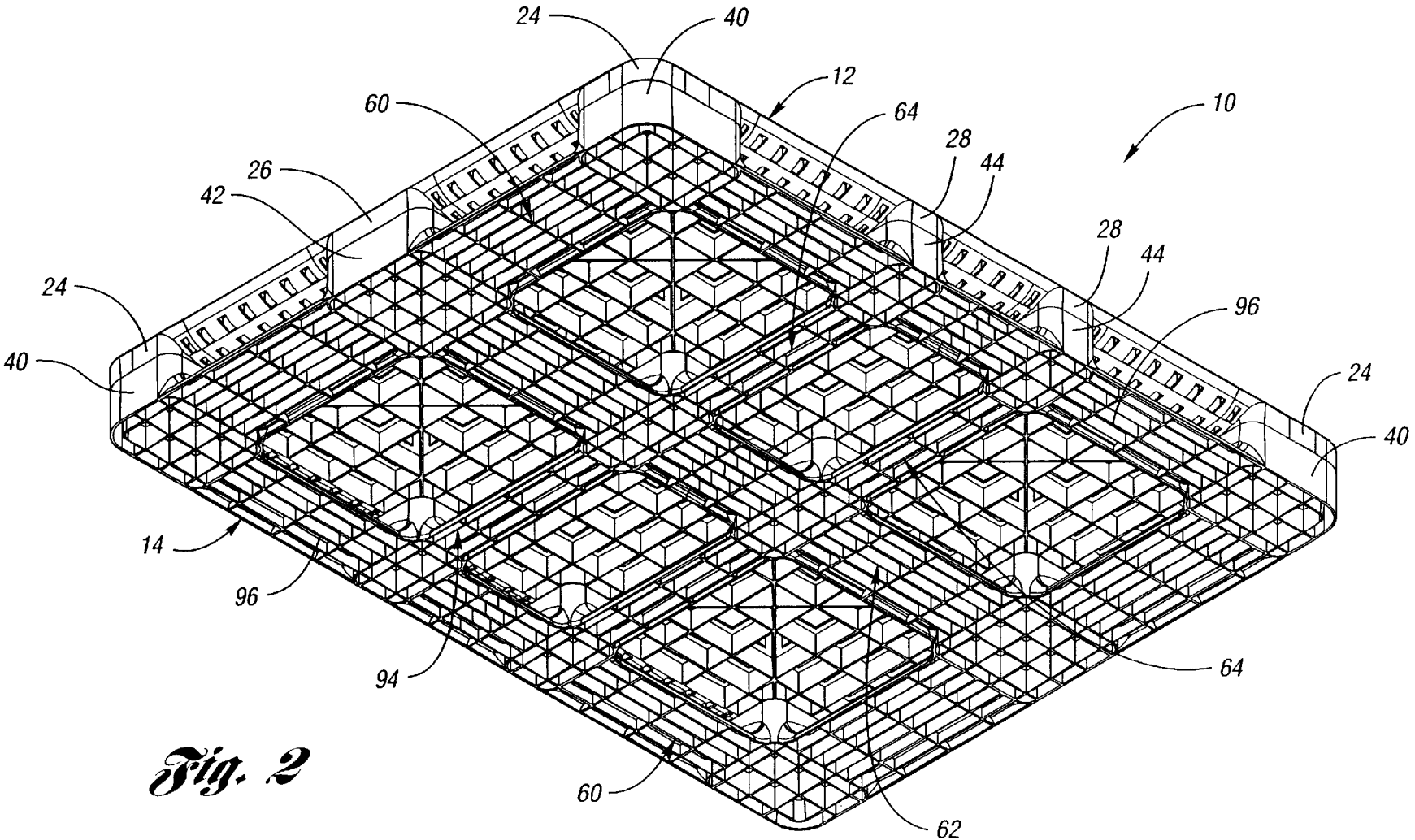
FIG. 2 is a bottom perspective view of the pallet of FIG. 1.
Figure 3:
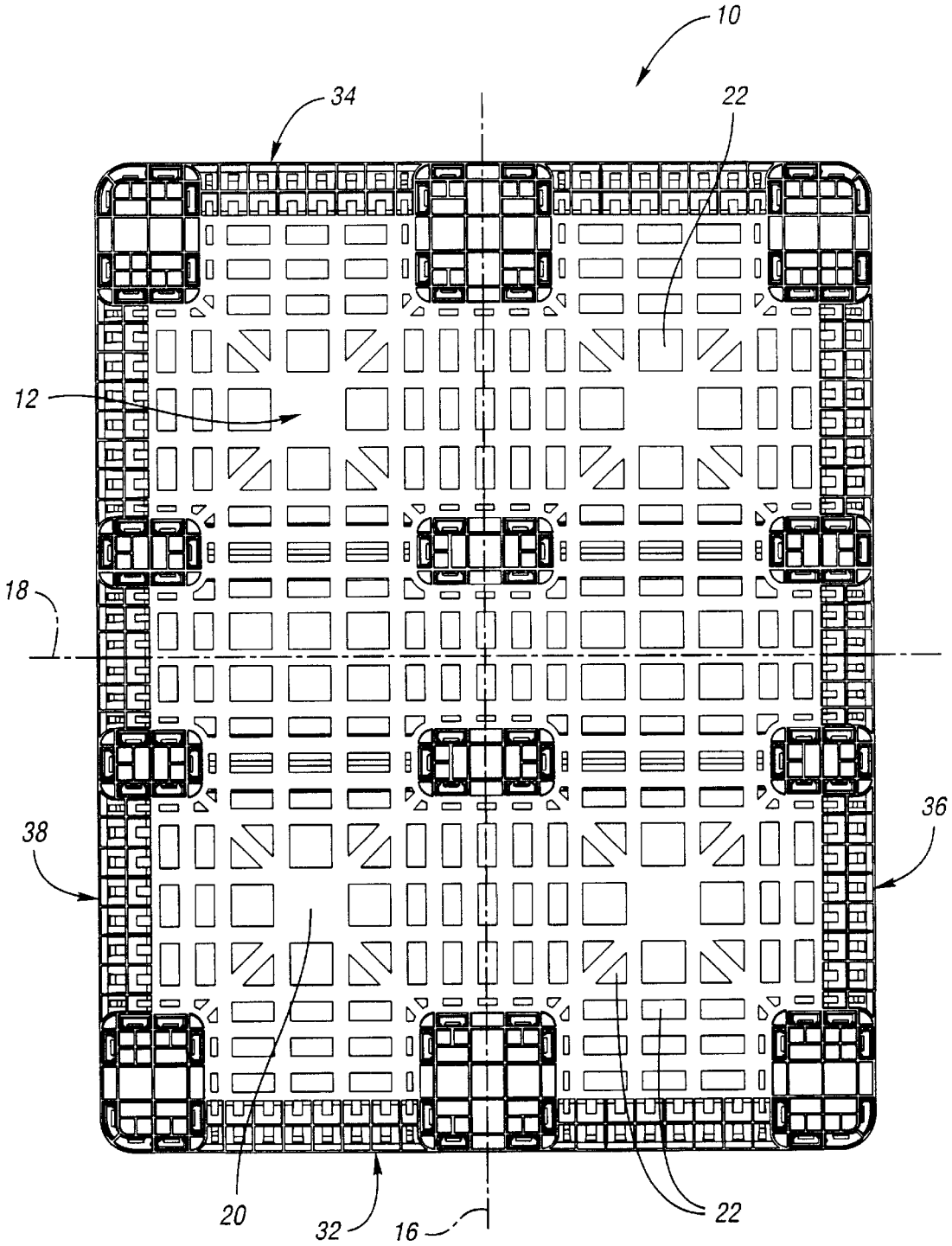
FIG. 3 is a top plan view of the pallet of FIG. 1.

As shown in FIGS. 2 and 4, the bottom surface 94 of lower deck 14 has several series of reinforcing ribs 96 which provide structural rigidity for the deck 14 and properly distribute the load carried by the upper deck 12 and the supports 40, 42, 44.

While a rectangular pallet 10 has been illustrated and described in the preferred embodiment, other shapes, e.g., square, are fully capable of embodying the features of the invention. The cross-sectional shapes of the receiving areas 24, 26, 28 and the supports 40, 42, 44 also may vary somewhat from those shown.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pallet, comprising:

spaced upper and lower decks;

a plurality of receiving areas formed in one of the upper and lower decks, each receiving area including at least one latch member extending therefrom; and a plurality of corresponding supports extending from the other of the upper and lower decks, each support including at least one latch receiver extending therefrom, the at least one latch receiver having a plurality of spring arms, wherein the at least one latch receiver is adapted to receive the at least one latch member such that engagement of the receiving areas and corresponding supports securely joins the upper and lower decks in an assembled configuration.

2. The pallet according to claim 1, wherein the receiving areas are integrally formed within a bottom surface of the upper deck, and the supports are integrally formed with and project upwardly from a top surface of the lower deck.

3. The pallet according to claim 1, wherein each receiving area includes a plurality of ribs, and the at least one latch member extends outwardly from one of the ribs at a lower end thereof.

4. The pallet according to claim 3, wherein the latch member tapers upwardly and outwardly from the lower end of the rib and terminates in a generally horizontal shoulder portion.

5. The pallet according to claim 1, wherein each support includes a plurality of ribs, and the plurality of spring arms includes two arms attached to one of the ribs at an upper end thereof, the arms being connected by a bridge portion which is adapted to receive a shoulder portion of the latch member thereunder.

6. The pallet according to claim 5, wherein the latch receiver is flexible, such that engagement of the receiving areas and corresponding supports causes the latch member to contact the bridge portion and deflect the latch receiver outwardly from its resting position, and passage of the shoulder portion past the bridge portion allows the latch receiver to return to its rest position and securely retain the latch member therewithin.

7. The pallet according to claim 1, further including guide members at least partially surrounding each latch receiver.

8. The pallet according to claim 7, wherein each guide member includes a wall structure having a first portion extending generally parallel to at least one latch receiver and a second portion extending along at least one side of one latch receiver.

9. The pallet according to claim 7, wherein guide members located at the corners of the pallet each include a curved wall which at least partially surrounds two adjacent latch receivers.

10. The pallet according to claim 7, wherein the guide members are tapered with the lower end of each guide member being wider than the upper end thereof.

11. The pallet according to claim 7, wherein each receiving area includes compartments which are sized to receive the individual guide members.

12. The pallet according to claim 11, wherein the at least one latch member is disposed in one of the compartments.

13. The pallet according to claim 1, wherein the pallet is generally rectangular and includes twelve supports and twelve corresponding receiving areas.

14. The pallet according to claim 13, wherein the supports include corner supports that project from the four corners of the pallet, medial supports that project from each end of a longitudinal rail extending along a longitudinal axis of the pallet, and transverse supports that project from the ends and midpoint of transverse rails extending parallel to a transverse axis of the pallet.

15. The pallet according to claim 14, wherein the corner supports and medial supports each include eight spaced latch receivers, and the transverse supports each include six spaced latch receivers.

16. The pallet according to claim 1, wherein the at least one latch receiver is generally U-shaped.

17. A pallet, comprising:

a first deck including a plurality of receiving areas formed therein, each receiving area including at least one latch member extending therefrom; and a second deck including a plurality of supports extending therefrom, each support including at least one latch receiver extending therefrom, the at least one latch receiver including a plurality of flexible spring supports;

wherein the at least one latch receiver is adapted to receive the at least one latch member such that engagement of the receiving areas and corresponding supports securely joins the first and second decks in an assembled configuration.

18. The pallet according to claim 17, wherein the plurality of flexible spring supports includes two arms, wherein the arms are connected by a receiving face such that the latch receiver is generally U-shaped.

19. The pallet according to claim 18, wherein the at least one latch member includes a generally horizontal shoulder portion adapted to be received by the receiving face of the at least one latch receiver.

20. The pallet according to claim 19, wherein engagement of the receiving areas and the corresponding supports causes the at least one latch member to contact the receiving face and deflect the at least one latch receiver outwardly from its resting position, and passage of the shoulder portion past the receiving face allows the at least one latch receiver to return to its rest position and securely retain the at least one latch member therewithin.

21. The pallet according to claim 17, further including guide members at least partially surrounding each latch receiver.

22. The pallet according to claim 21, wherein each receiving area includes compartments which are sized to receive the individual guide members.

23. A two-piece plastic pallet, comprising:

a first deck including a plurality of receiving areas formed in a first mating surface, wherein each receiving area includes a plurality of outwardly projecting latch tabs; and a second deck including a plurality of supports formed in a second mating surface, each support including a plurality of projecting latch receivers and guide wall structures spaced from and at least partially surrounding each latch receiver, wherein the latch receivers are adapted to receive the latch tabs such that engagement of the receiving areas and corresponding supports securely joins the first and second decks in an assembled configuration, and engagement of the guide wall structures with the receiving areas provides lateral stability for the assembled first and second decks.

24. The pallet according to claim 23, wherein each receiving area includes a plurality of ribs, and the latch tabs taper upwardly and outwardly from lower ends of the ribs and terminate in generally horizontal shoulder portions.

25. The pallet according to claim 24, wherein each support includes a plurality of ribs, and the latch receivers each include two arms attached to one of the ribs at an upper end thereof, the arms being connected by a bridge portion such that each latch receiver has a generally U-shaped appearance, wherein the bridge portion is adapted to receive the shoulder portion of the latch tab thereunder.

26. The pallet according to claim 25, wherein the latch receiver is flexible, such that engagement of the receiving areas and corresponding supports causes the latch tab to contact the bridge portion and deflect the latch receiver outwardly from its resting position, and passage of the shoulder portion past the bridge portion allows the latch receiver to return to its rest position and securely retain the latch tab therewithin.

27. The pallet according to claim 23, wherein the guide wall structures are tapered with the lower end of each guide wall structure being wider than the upper end thereof, and wherein each receiving area includes a plurality of compartments which are sized to receive the individual guide wall structures.

28. The pallet according to claim 23, wherein the pallet is generally rectangular and includes twelve supports and twelve corresponding receiving areas, the second deck having a perimeter portion and cross rails connected thereto to define large openings in the second deck, the cross rails including a longitudinal rail joined to the perimeter portion and extending along a longitudinal axis of the pallet, and two transverse rails joined to the perimeter portion and the longitudinal rail and extending parallel to a transverse axis of the pallet, wherein corner supports project from the four corners of the perimeter portion, medial supports project from each end of the longitudinal rail, and transverse supports project from the ends and midpoint of each transverse rail.

29. In a pallet comprising upper and lower decks spaced apart by a plurality of supports, wherein the supports project upwardly from the lower deck and are adapted to be received in receiving areas formed in a bottom surface of the upper deck, a latch assembly for securely joining the upper and lower decks in an assembled configuration, the latch assembly comprising:

at least one latch member disposed within each receiving area, the latch members each including a generally horizontal shoulder portion which tapers downwardly and inwardly toward a bottom surface of the receiving area; and at least one flexible latch receiver extending upwardly from each support, the latch receivers each having a plurality of spring arms connected to the support and a receiving face attached to the arms, wherein the receiving face is adapted to receive the shoulder portion of the latch member thereunder, wherein engagement of the receiving areas and corresponding supports causes the latch member to contact the receiving face and deflect the latch receiver outwardly from its resting position, and passage of the shoulder portion past the receiving face allows the latch receiver to return to its rest position and securely retain the latch member therewithin, thereby securing the upper and lower decks in the assembled configuration.

30. The latch assembly according to claim 29, further including guide members at least partially surrounding each latch receiver.

31. The latch assembly according to claim 30, wherein each guide member includes a wall structure having a first portion extending generally parallel to at least one latch receiver and a second portion extending along at least one side of one latch receiver.

32. The latch assembly according to claim 30, wherein the guide members are tapered with the lower end of each guide member being wider than the upper end thereof.

33. The latch assembly according to claim 32, wherein the individual guide members are adapted to be received in corresponding compartments formed in each receiving area to provide lateral stability for the assembled upper and lower decks.

34. A pallet, comprising:

a first deck including a plurality of first mating areas, each first mating area including at least one latch member; and a second deck including a plurality of second mating areas, each second mating area including at least one latch receiver having a pair of spaced apart flexible arms, the arms having first ends which are attached to the second deck and second ends which are coupled together, wherein the at least one latch receiver is arranged to receive the at least one latch member such that engagement of the corresponding first and second mating areas joins the first and second decks in an assembled configuration.

* * * * *